US007579533B2

(12) United States Patent
Jones

(10) Patent No.: US 7,579,533 B2
(45) Date of Patent: Aug. 25, 2009

(54) HEAD ASSEMBLY FOR STRING INSTRUMENTS AND METHOD FOR MANUFACTURING STRING INSTRUMENTS

(76) Inventor: Douglas D. Jones, 1520 Granger Ave., Ann Arbor, MI (US) 48104

( * ) Notice: Subject to any disclaimer, the term of this patent is extended or adjusted under 35 U.S.C. 154(b) by 485 days.

(21) Appl. No.: 11/273,682

(22) Filed: Nov. 14, 2005

(65) Prior Publication Data

US 2006/0101980 A1 May 18, 2006

Related U.S. Application Data

(60) Provisional application No. 60/627,567, filed on Nov. 12, 2004.

(51) Int. Cl.
*G10D 3/00* (2006.01)

(52) U.S. Cl. ..... 84/291

(58) Field of Classification Search ..... 84/312 ER, 84/314 N, 327, 329, 421, 312 R, 267, 290, 84/291

See application file for complete search history.

(56) References Cited

U.S. PATENT DOCUMENTS 3,833,751 A 9/1974 Chapman
4,530,268 A 7/1985 Starrett
4,633,754 A 1/1987 Chapman
4,950,437 A 8/1990 Lieber
5,033,351 A 7/1991 Nomura
5,072,643 A 12/1991 Murata
5,955,688 A 9/1999 Cook
6,051,773 A * 4/2000 Rose ..... 84/743
6,087,568 A 7/2000 Seal
6,100,458 A 8/2000 Carrington et al.
6,107,552 A 8/2000 Coomar et al.
6,369,306 B2 4/2002 Chapman
6,538,183 B2 3/2003 Verd
6,657,113 B2 12/2003 Herman

* cited by examiner

*Primary Examiner*—Kimberly R Lockett
(74) *Attorney, Agent, or Firm*—Brinks Hofer Gilson & Lione

(57) ABSTRACT

A stringed instrument and a method of forming the stringed instrument are provided. The instrument includes a head assembly having individually and continuously adjustable nuts for varying the height each string. The head assembly also provides simple and reliable tensioning of the strings. The method of forming the instrument includes in-molded frets to ensure their planarity and alignment.

16 Claims, 9 Drawing Sheets

HEAD ASSEMBLY FOR STRING INSTRUMENTS AND METHOD FOR MANUFACTURING STRING INSTRUMENTS

CROSS-REFERENCE TO RELATED PATENT APPLICATIONS

This patent application claims the benefit of U.S. provisional patent application 60/627,567, filed Nov. 12, 2004.

FIELD OF THE INVENTION

The present invention relates generally to a stringed instrument, and more particularly relates to a head assembly for the instrument and a method of manufacturing the instrument.

BACKGROUND OF THE INVENTION

A large number of stringed instruments utilize a head assembly to control the tension and orientation of the strings, and thereby regulate the tune of the instrument. Typically, the end of the string is connected to a rotatable peg, which in turn is rotated to adjust the tension on the string. While such mechanisms have had a long and successful history, there remains room for improvement to the head assembly, and in particular the integrity of the system for maintaining the desired tuning, as well as the degrees of adjustability of the individual strings.

Additionally, one particular guitar-like instrument is commonly known as a Chapman stick, given its name by inventor Emmett Chapman and as shown in U.S. Pat. No. 3,833,751. While the Chapman stick has been gaining in popularity and has received much acclaim, there remains room for improving the construction of the instrument to improve sound, protect against EMF (electromagnetic interference) and allow for mass production of the instrument.

BRIEF SUMMARY OF THE INVENTION

The present invention provides a head assembly for any stringed instrument, and preferably a Chapman stick, which allows the use of single-ball strings while securely holding the tension on the string. At the same time, the head assembly provides additional degrees of adjustability to the strings, and provides an individual nut for each string which permits continuously variable adjustment of the height of the string.

An embodiment of the present invention also provides a method for manufacturing a guitar-like instrument such as a Chapman stick. Generally, the fingerboard is constructed in a manner which insures perfect vertical alignment of the individual frets, while permitting variation in the exposed surface of the fingerboard to provide such features as scallops between the frets. Likewise, a unique construction of the fingerboard and its shell of a composite material provides strength and rigidity to permit the instrument to be generally hollow and without need for additional support, while at the same time permitting mass production and shielding against electromagnetic interference.

DETAILED DESCRIPTION OF THE INVENTION

Figure 1:
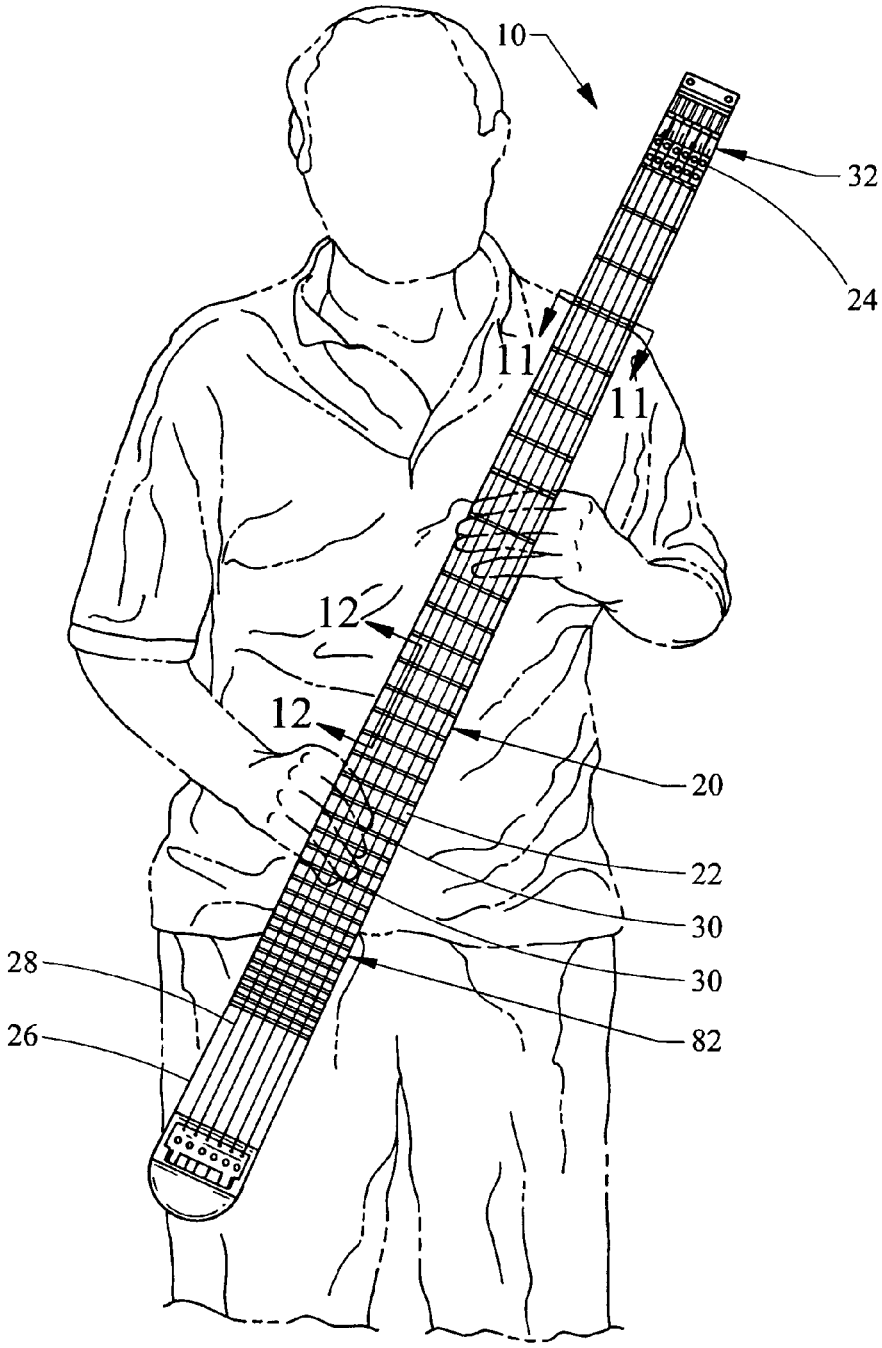
FIG. 1 is a photograph of a musician holding a stringed instrument constructed in accordance with the teachings of the present invention.
Figure 2:
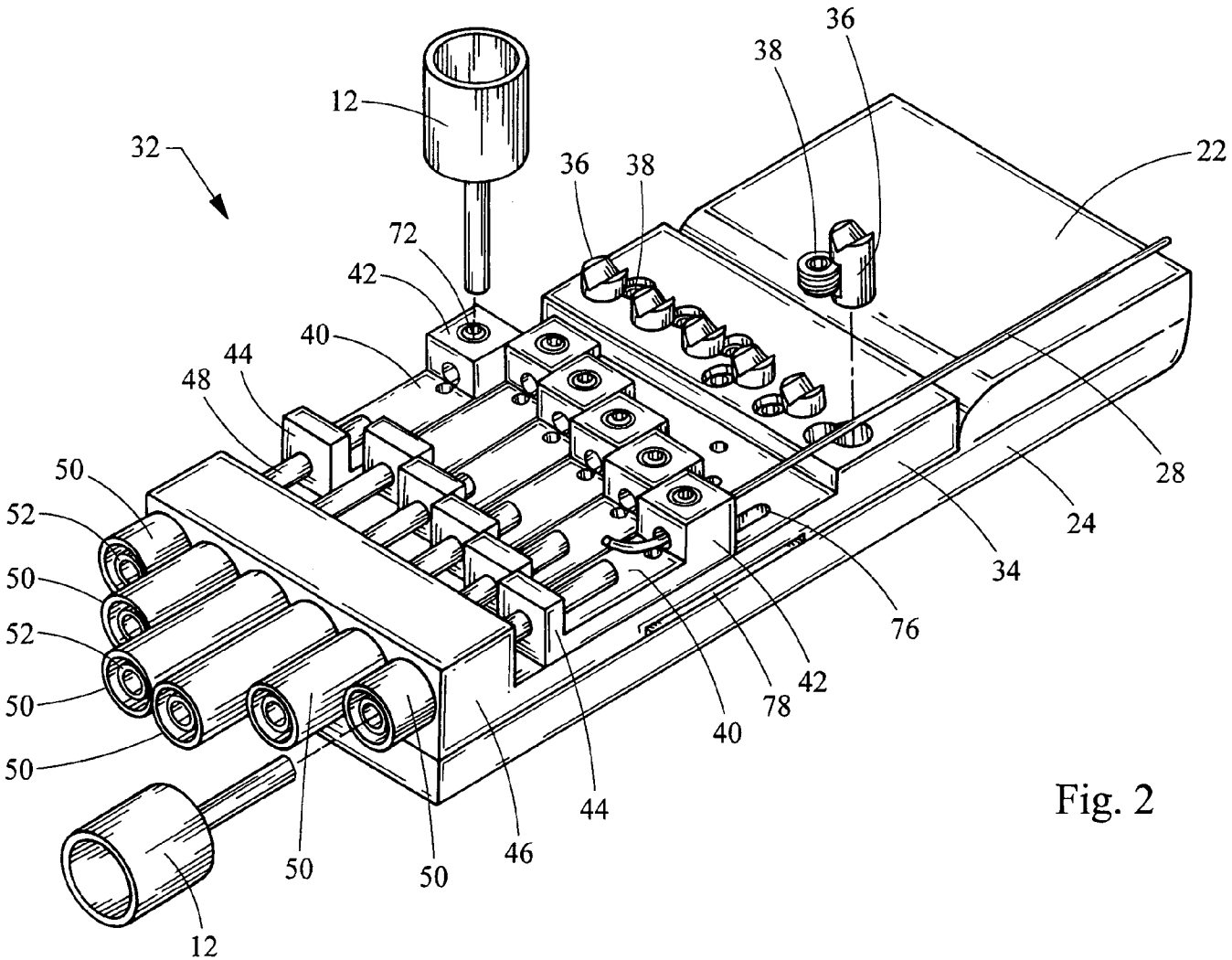
FIG. 2 is a perspective view of a head assembly forming a portion of the instrument depicted in FIG. 1.

Turning now to the figures, FIG. 1 depicts a musician 10 holding a guitar-like instrument 20 constructed in accordance with the teachings of the present invention. The instrument 20 is in the form of a Chapman stick, although it will be recognized by those skilled in the art that the head assembly 32 of the present invention may be applied to any stringed instrument, as will be discussed in further detail herein.

The instrument 20 generally includes a main body 20 having a head 24 and a tail 26. Any number of strings 28 may be strung longitudinally across the main body 22 spanning from the head 24 to the tail 26. A top surface of the main body 22 defines a fingerboard 82 having a plurality of frets 30 extending laterally across the body 22. As is known in the art, the instrument 20 is preferably an electric, stringed instrument that requires amplification. It is played by striking, hammer on/pull off technique, strumming or a combination of the foregoing. It can be played in numerous positions, such as being supported on the body, or a stand, or an end pin such as in a cello. It can be held with a strap, knee bar, or on a belt hook or in one's lap.

Figure 3:
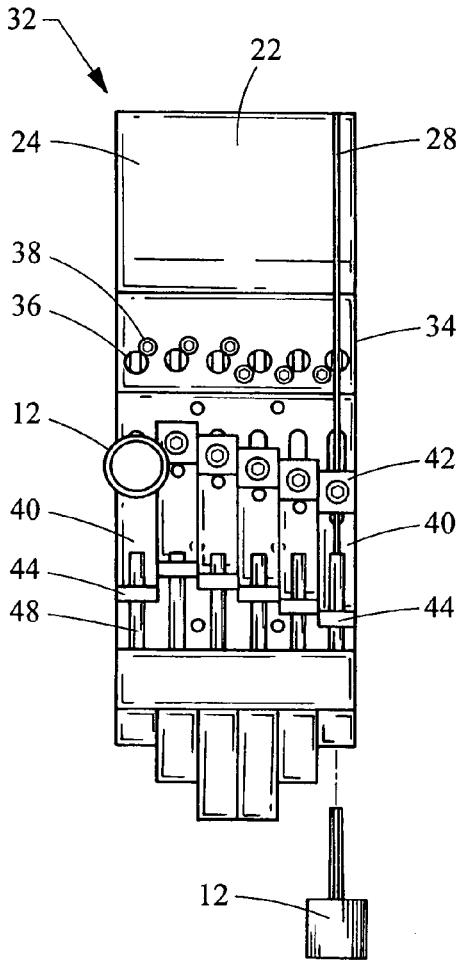
FIG. 3 is a plan view of the head assembly depicted in FIG. 2.
Figure 5:
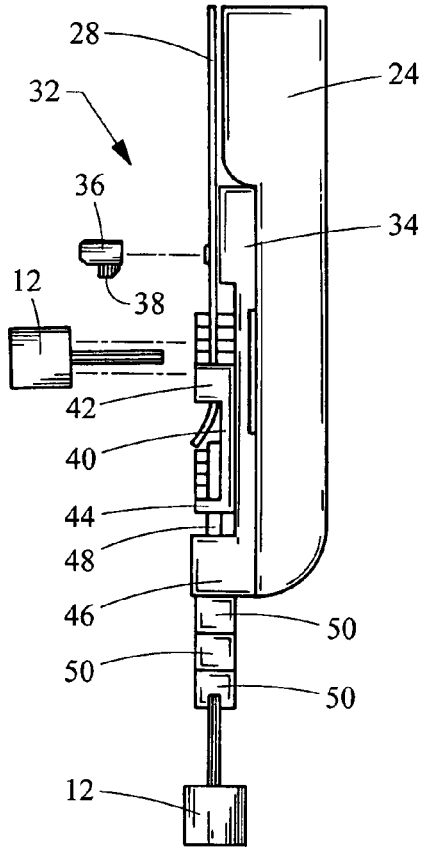
FIG. 5 is a side view of the head assembly depicted in FIG. 2.
Figure 4:
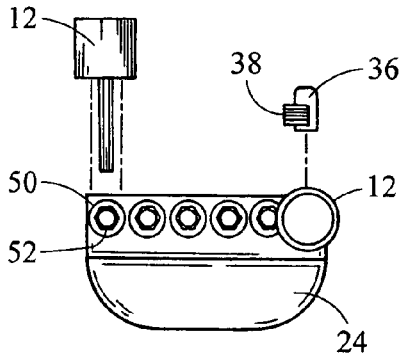
FIG. 4 is an end view of the head assembly depicted in FIG. 2.

The head assembly 32 will now be described with reference to FIGS. 2-10. As shown in FIGS. 2-5, the head assembly 32 generally includes a main body 34 which is structured to receive a free end of the each string 28. One feature of the head assembly 32 is the provision of an adjustable nut 36 for each string 28, which can be considered as the last fret for each string 28. This row of nuts 36 is the counterpoint to the bridge (the bridge being a structure that aligns the strings both in relation to the spacing between strings and the distance between the strings from the body at the tail end). The body or headpiece 34 includes a plurality of holes for each adjustable nut 36. Likewise, the headpiece 34 includes a threaded hole for a number of elevator screws 38 which correspond to each nut 36. As best seen in FIG. 3, the holes for the adjustable nut 36 and elevator screw 38 partially overlap. It can also be seen in FIG. 3 that the threaded opening for the elevator screw 38 may be positioned anywhere relative to the hole for adjustable nut 36 so long as the holes partially overlap.

Figure 7:
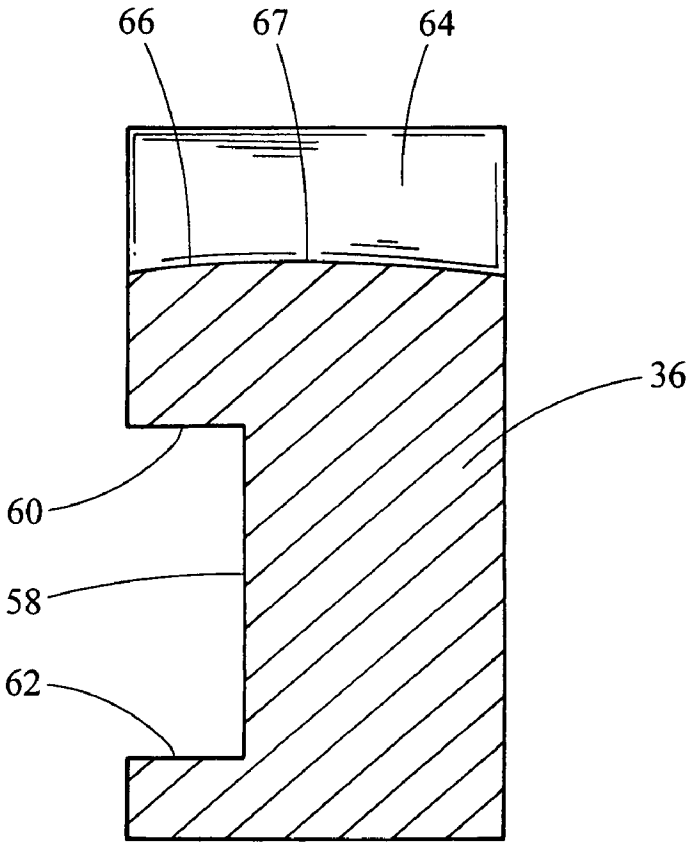
FIG. 7 is cross-sectional view taken about the line 7-7 in FIG. 6.
Figure 6:
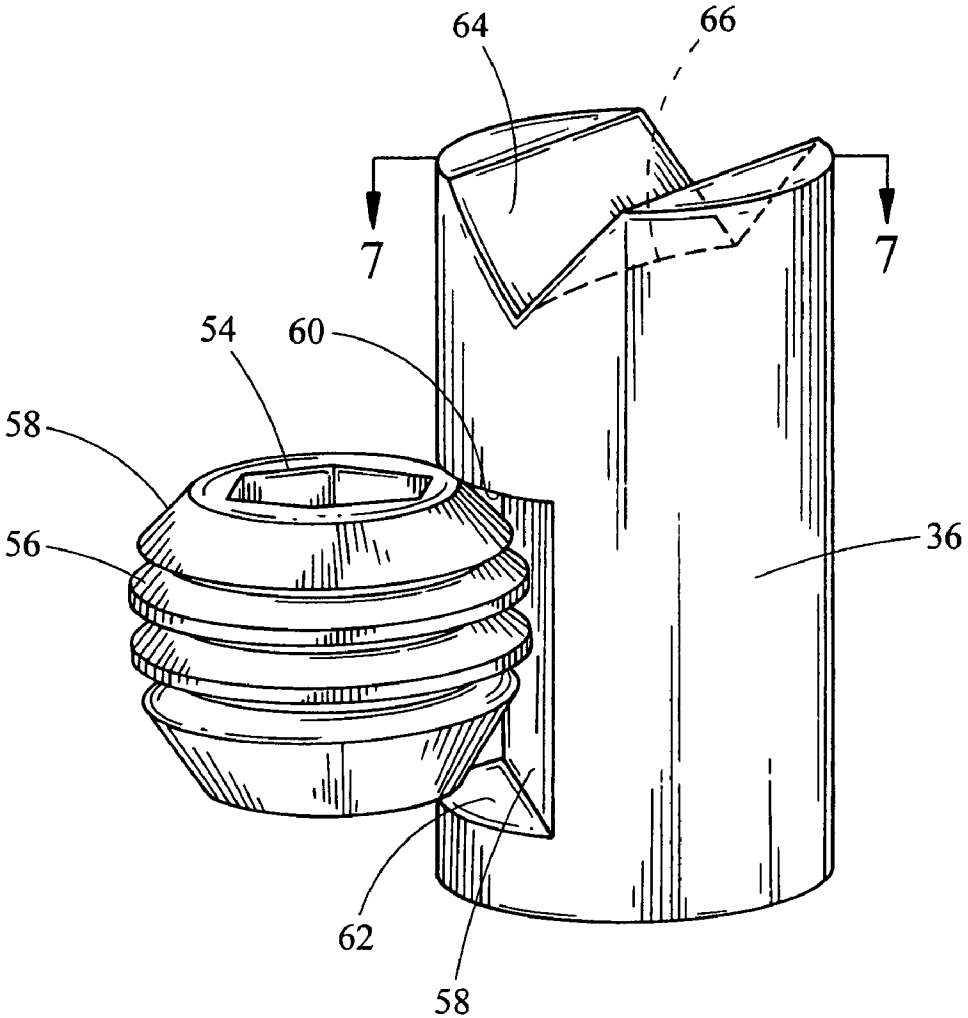
FIG. 6 is an enlarged view of an adjustable last fret forming a portion of the head assembly depicted in FIGS. 2-5.

As best seen in FIGS. 6 and 7, the adjustable nut 36 includes a recess 58 for receiving the elevator screw 38. The recess 58 includes an upper surface 60 and a lower surface 62 which is positioned to engage upwardly and downwardly facing surfaces of the elevator screw 38. The elevator screw 38 includes a female Allen socket 54 for rotating the screw 38 via an Allen wrench or key 12. The threads 56 permit vertical adjustment of the elevator screw 38 through their rotation and engagement with the threaded opening in the head piece 34. Accordingly, it will be recognized by those skilled in the art that through adjustment of the elevator screw 38, the screw engages the upper surface 60 or the lower surface 62 of the recess 58 and the adjustable nut 36 to permit continuously variable adjustment of the nut 36 and the height thereof. Thus, the height of each individual string 28 may thereby be controlled and positioned at an infinite number of vertical locations.

It can also be seen in FIGS. 6 and 7 that an upper end of each adjustable nut 36 includes a notch 64 which defines a string engaging surface 66 at the base of the notch. As best seen in FIG. 7, the string engaging surface 66 is preferably curved or otherwise sloped such that it provides a peak 67 which defines the engagement point for each string 28. In this manner, the longitudinal position at which each adjustable nut 36 engages each string 28 may be aligned relative to the longitudinal axis of the instrument 20 to insure accuracy in the tuning of the instrument 20.

Figure 8:
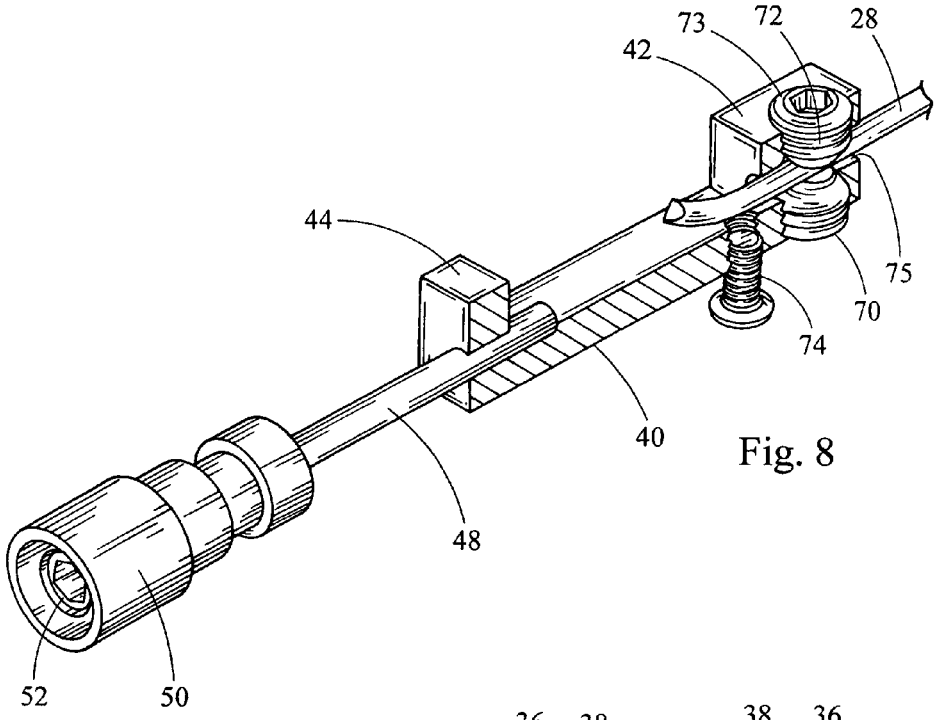
FIG. 8 is a perspective view, partially cut-away, of a draw bar forming a portion of the head assembly depicted in FIGS. 2-5.

Turning back to FIGS. 2-5, once each string 28 passes over its adjustable nut 36, the end of the string is received by a drawbar 40. Each drawbar 40 includes a clamp 42 for securely retaining the free end of each string 28. An opposing end of the drawbar 40 defines a flange 44. As best seen in FIG. 8, the clamp 42 includes lower and upper set screws 70, 72, respectively. It will be recognized that the lower set screw 70 may be replaced by a single post or other surface, as it is not exposed to the face of the instrument 10. In either case, the upper set screw 72 includes a female Allen receptacle 73 for height adjustment. The string 28 is threaded through passageway 75 formed in the clamp 42, and the screw 73 is tightened using the same Allen wrench or key 12 (FIGS. 2-5) used for the last frets 36, in order to clamp the string 28 between set screws 70, 72.

Figure 9:
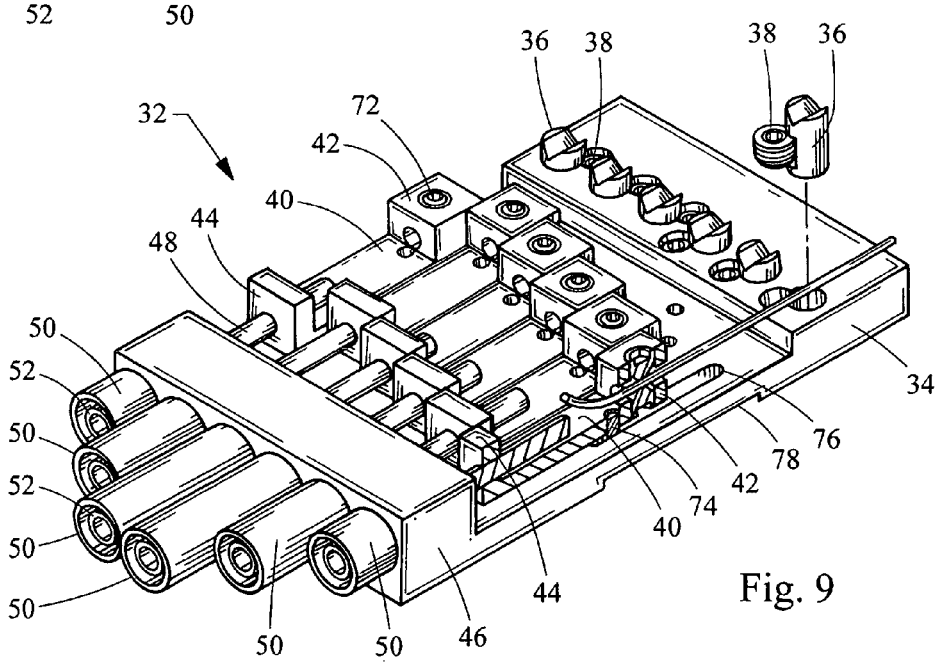
FIG. 9 is perspective view of the head assembly depicted in FIGS. 2-5 but having a section of the draw bar depicted in FIG. 8 cut-away.
Figure 10:
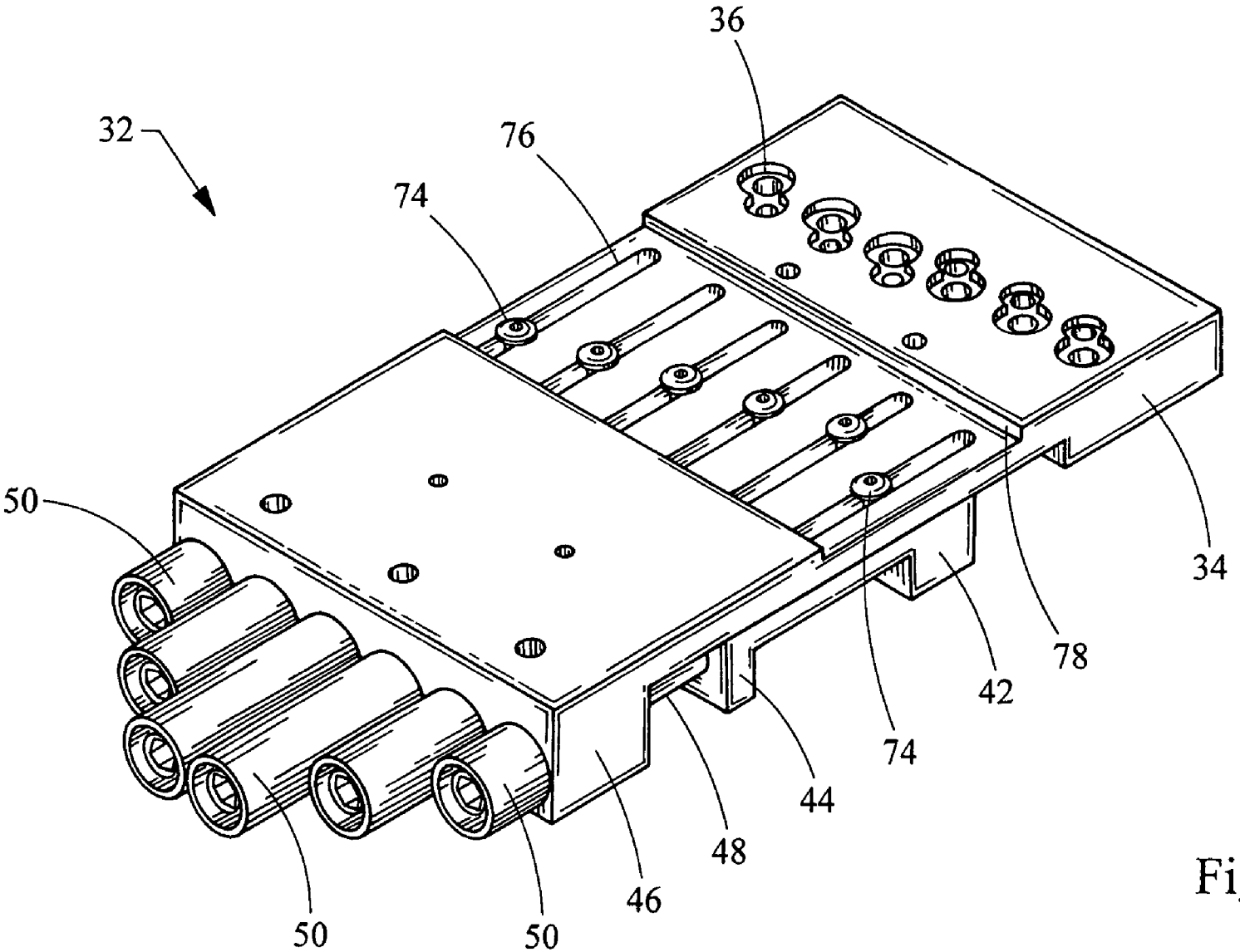
FIG. 10 is a perspective view, taken from the bottom, of the head assembly depicted in FIGS. 2-5.

It can be seen in FIG. 8 that a guide screw 74 has been placed in a threaded opening formed in the drawbar 40. As best seen in FIG. 9, the head piece 34 includes a slot 76 which is sized to receive the guide screw 74. In this manner, the drawbar 40 may be translated longitudinally as guided by the slot 76 and the set screw 74 which extends therethrough. As shown in FIG. 10, the head piece 34 includes a recess 78 which is spaced from the main body 22 to provide clearance for the head of guide screw 74.

Turning back to FIGS. 2-5, the flange 44 of each draw bar 40 is connected to a tensioner screw 48. The tensioner screw 48 extends through a block 46 which is defined by the headpiece 34. A thumb nut 50 is connected to the free end of the tensioner screw 48 and is exposed for access by the musician 10. The flange 44 defines a threaded opening through which the tensioner screw 48 is threadingly engaged. Accordingly, it will be recognized that by rotation of the thumb nut 50 and tensioner screw 48, the drawbar 40 may be longitudinally translated as the screw 48 is rotated within the flange 44 of drawbar 40. As previously discussed the slot 76 and guide screw 74 provide a guide or rail system through which the draw bar 40 is directed.

As with the elevator screw 38 and the clamp screw 72, the tensioner screw 48 includes a female Allen receptacle 52 positioned at the end thereof. This permits all of the aforementioned screws to be adjusted with a single tool such as a simple Allen wrench 12. Preferably, the female Allen receptacle 52 is inset slightly from the exposed end of thumb nut 50, and most preferably each thumb nut 50 includes a tapered inset such that the wrench 12 is easily guided to the female Allen receptacle 52. As can also be seen from the figures, the thumb nut 50 may be provided in different lengths to allow easy access to each of the individual thumb nuts 50 by the musician 10.

Accordingly, it will be recognized by those skilled in the art the head assembly 32 provides a unique adjustability to the string instrument 20. First, a last row of individual frets 36 is provided, each of the frets 36 being continuously variable in the vertical direction to individually adjust the height of each string 28. Furthermore, the drawbar 40 includes a clamp 42 which allows single-ball strings to be utilized, and thus obviates the need for expensive double-ball end strings. Still further, the longitudinal adjustment of drawbar 40 and thereby the tension in string 28 is accomplished through a tensioner screw 48 which is longitudinally aligned with the axis of the instrument 10 and each string 28. Thus, the direction of rotation (i.e. the plane of rotation) generally perpendicular to the string 28. In this manner, the tension in string 28 will be unable to unwind the tensioner screw 48 which is aligned with the longitudinal axis, as opposed to being perpendicular thereto as is common in most head assemblies. Finally, the thumb nuts 50 which can be used to adjust the tension are provided with different lengths to provide easy access to each nut 50, while at the same time all the aforementioned mechanisms (adjustable nut 36, 38, clamp 42, 72, and drawbar/screw 40, 48) may be adjusted with a single tool such as an Allen wrench 12.

Figure 11:
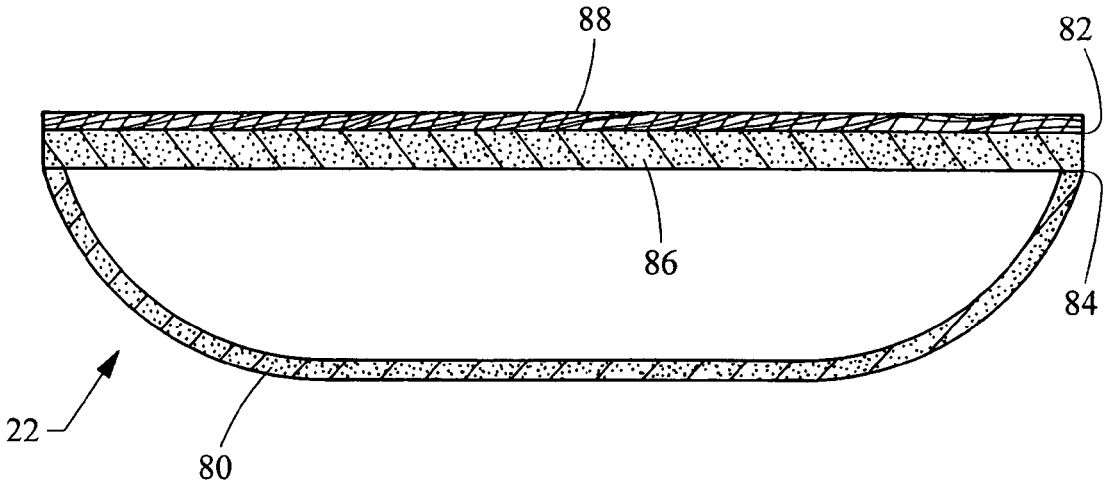
FIG. 11 is a cross-sectional view taken about the line 11-11 in FIG. 1.

Additional features of the instrument 20 will now be described with reference to FIGS. 11 and 12, as well as the additional photographs and unnumbered pictures forming a portion of this application. As shown in FIG. 11, the main body 22 of the instrument 20 is preferably constructed of a shell 80 and a fingerboard 82. The shell 80 generally includes curved sidewalls which extend up to and engage a bottom surface of the fingerboard 82 and form a joint 84. It will be recognized that the sidewalls need not be curved or may extend generally vertically and only a small radius provided at the corners. Preferably, both the fingerboard 82 and the shell 80 are constructed of a composite material, and most preferably a carbon fiber material impregnated with a resin such as an epoxy. In this manner, the joint 84 may be formed by using an epoxy, although other techniques such as vibrational welding, ultrasonic welding, clamps or other fastening mechanism or techniques may be readily employed.

By forming the shell 80 and fingerboard 82 of a composite material such as a carbon fiber composite, the main body 22 has sufficient rigidity and torsional strength that additional supporting structures (e.g. a truss rod) are not needed. Thus, the main body 22 may generally be hollow and therefore the instrument 20 is very lightweight. At the same time, the carbon fibers forming the matrix of the main body 22 is an inherent shield against electromagnetic interference, which is becoming an increasing problem with musical instruments. For example, a magnetic pickup may be readily employed with the instrument 20 and likewise numerous other electronic devices such as amplifiers, speakers, etc., can affect the sound produced by the instrument 20.

Figure 12:
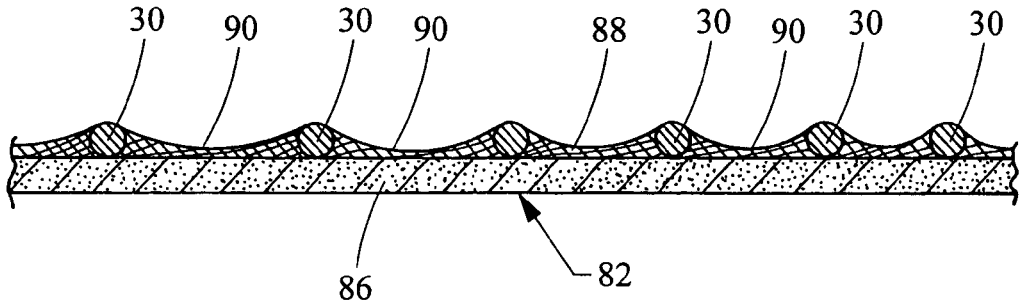
FIG. 12 is a cross-sectional view taken about the line 12-12 in FIG. 1.

As seen in FIG. 12, the fingerboard 82 preferably includes a composite substrate 86 as previously discussed, as well as an additional surface layer 88. Preferably, the surface layer 88 is constructed purely of an epoxy or other adhesive or polymer which provides a smooth surface that while sensitive to the touch of the musician 10, has sufficient durability to handle the abrasion from strings 28 and the fingers of the musician 10. Preferably the frets 30 are constructed of a stainless steel material and are round, although numerous other shapes and materials may be used for the frets 30 as is known in the art.

In a preferred construction process, a female mold is provided which includes channels for receiving elongated stainless steel rods which are to be the frets 30 of the fingerboard 82. The female mold also preferably defines a shape for the exposed surface of fingerboard 82. As shown in FIG. 12, the exposed surface preferably includes a plurality of peaks and troughs, or stated another way include a plurality of scallops 90 formed between each of the frets 30. The scallops are considered by many musicians 10 to provide optimal feel, although the shape of the exposed surface of fingerboard 82 may take any shape depending on an individual's preference. Preferably, a portion of each fret 30 is left exposed above the layer 88. As such, the female mold generally includes a first depression defining the scallops 90 and a second depression within, and preferable at the peak of the first depressions, for receiving the frets 30.

Once the long stainless steel rods are positioned in the female mold in their respective channels, a cover such as a piece of glass is placed over the rods and an epoxy is injected therein to form the exposed layer 88 of the fingerboard 82. By utilizing a female mold and the glass cover, the vertical alignment of the rods and hence frets 30 is insured. Then, either before or after the epoxy layer 88 has set, carbon fiber or other matrix material may be placed over the layer 88. Then, the glass or other containing surface is replaced and the carbon fiber layer is impregnated with another injection of epoxy. It will be recognized by those skilled in the art that the first step of providing epoxy layer 88 may be eliminated, and the carbon fiber may be placed directly over the metal rods and the fiber matrix may be injected and infused with epoxy which will naturally encompass the metal rods and define a exposed surface that is scalloped. Further, it will be recognized that a vacuum bag unit may be used to evacuate air prior to injecting the epoxy to eliminate any air bubbles or the like forming therein. Likewise, an autoclave may be used to infuse the mold with epoxy.

The result of the molding process is a large sheet having the composite substrate 86 and epoxy layer 88 encasing the metal rods. This large sheet may then be cut into a number of individual fingerboards, and is preferably cut by a water jet which permits precise cutting of the shape of the fingerboard 82 as well as cutting through the metal rods, to thereby provide a smooth surface on the sides of the frets 30.

The shell 80 may be similarly formed in a mold which preferably has a curved female mold to provide the curved shape to the shell 80. The carbon fiber mat is placed over the female mold and then the mold is covered with sheet plastic vacuum bagging material and a seal around the perimeter. Again the air is then evacuated and epoxy is injected and impregnates the carbon fiber to form the composite layer 80 defining the shell.

In the final steps, the shell 80 is attached to the fingerboard 82 to form a joint 84 therebetween. As previously mentioned, the joint 82 may be simply formed with an epoxy to connect the fingerboard 82 and shell 80, although other connection structures may be used as well as connection processes such as welding techniques. Alternatively, if the fingerboard substrate 86 and shell 80 were constructed of a thermo plastic or thermoformable polymer, welding the two pieces together could easily be accomplished through heat or appropriate vibration welding techniques.

To finish the construction, a tailpiece, numerous of which are well known in the art and can be readily purchased, is attached to the tail end 26 of the main body 22. This may be accomplished through screws, adhesives or other clamping mechanisms. Likewise, the head assembly 32 and its headpiece 34 are attached proximate the head 24 of the main body 22. As with the tailpiece, the head assembly may be connected in any preferred manner such as by adhesive, welding, clamps or screws or any fastening means. Finally, the instrument 20 is strung and is ready to be played by the musician 10.

It will also be recognized that the instrument, and in particular the fingerboard 82 and shell 80 may be constructed of a composite material which is provided on both sides of a core (such as cores of wood, foam or other known core materials) to provide a sandwiched construction. This will provide even further strength without requiring a truss rod for rigidity of the instrument.

Figure 13:
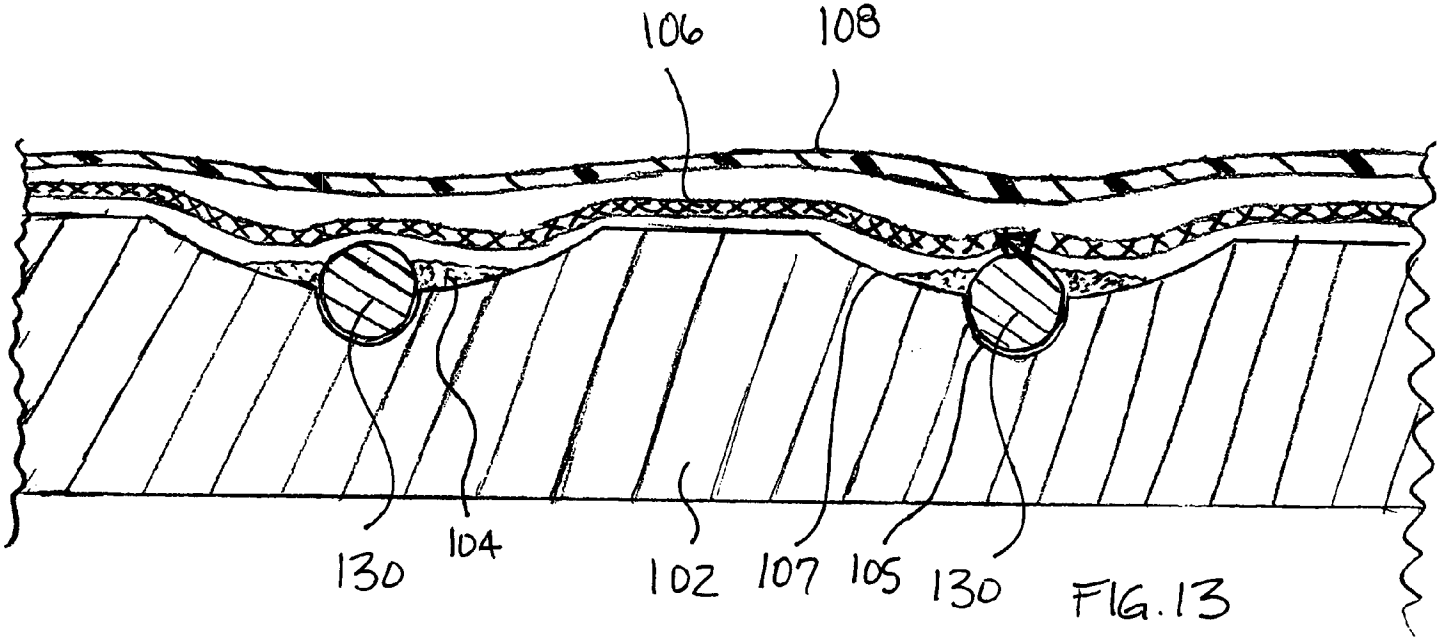
FIG. 13 is a cross-sectional view, partially cut-away, of a mold and raw materials for constructing an alternate embodiment of the stringed instrument of FIG. 1.
Figure 14:
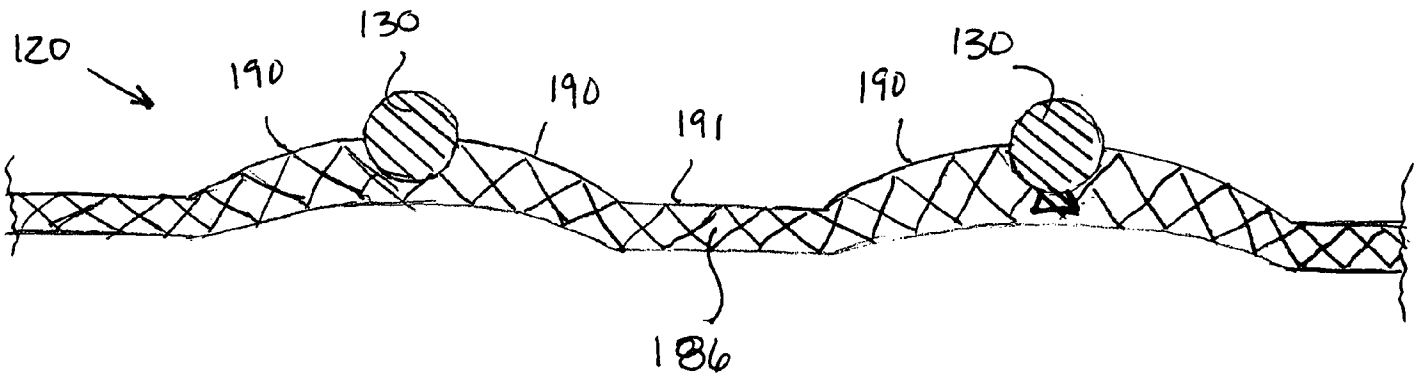
FIG. 14 is a cross-sectional view, partially cut-away, of the stringed instrument formed by the mold and materials of FIG. 13.
Figure 15:
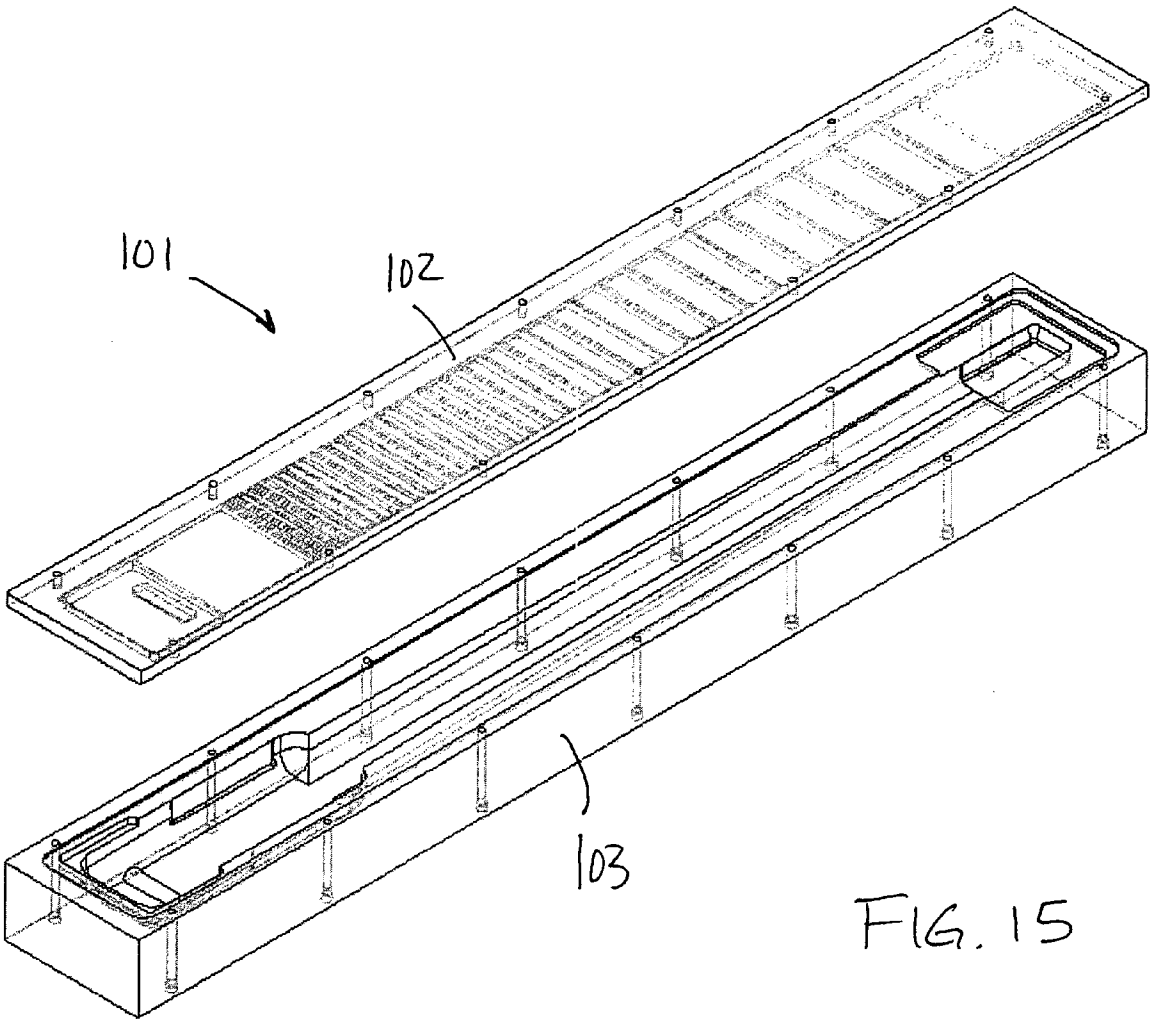
FIG. 15 is an exploded perspective view of the mold depicted in FIG. 13.

Another embodiment of the instrument 120 and method for its manufacture is depicted in FIGS. 13-15. Notably, the instrument 120 is unitarily formed (i.e. the shell 80 and fingerboard 82 of the prior embodiment are a single piece) ensuring truly planar fingerboard 186. Further, the frets 130 are in-molded (i.e. cast in-place) to the fingerboard 186 to further assure their planarity, perfect alignment, and secure attachment.

As shown in FIG. 15, the instrument 120 is manufactured in a closed mold 101 having an upper mold 102 and a lower mold 103 which receive sheets of a matrix material 106, preferably a pre-impregnated carbon fiber. With reference to FIG. 13, the upper mold 102 is turned over to reveal a series of first depressions 107 and second depressions 105. The second depressions 105 are formed at the apex of the first depressions 107, and receive individual frets 130 as shown. Optionally, a small amount of un-cured (gel) epoxy 104 may be poured into the first depressions 107, and preferably leave a portion of the frets 130 exposed. The supplemental epoxy 104 generally assists in the secure interconnection of the frets 130 to the resulting fingerboard 186, although the pre-impregnated resin of the matrix material 106 can be sufficient to secure the frets 130.

A composite sheet 106, preferably pre-impregnated as discussed above, is layered over upper mold 102 as well as the lower mold 103. Preferably the first sheet 106 is a fine woven sheet to provide an aesthetically pleasing outer surface to the instrument 120, which is then supplement with unidirectional sheet material (not-shown). Any number of composite layers may be employed depending on the particular instrument and requirements. Generally, each layer of material is smoothed out around the interior surface of the upper and lower molds 102, 103 and extends around to form a roll (which may overlap under the upper mold 102). The roll may be longitudinally or laterally aligned.

At least one internal bladder 108, such as an inflatable tube, is positioned inside this roll of matrix material 106, and inflated to securely press the material 106 against the interior surface of the mold 101 and conform to the designed surfaces. With the mold 101 closed, the mold 101 and its contents are subjected to heat for a predetermined period of time to cure the resin contained in the matrix material 106. Once cured, the instrument is removed, and the longitudinal sides trimmed to remove excess material and to cut the frets 130 to size. As with the prior embodiment, the various assemblies are added, and the instrument is strung. It will also be recognized that various structures, such as an internal nut for receiving an end pin or other stand, as well as mounting structures for the head assembly and tail piece, may readily be in-molded with the instrument for ease of manufacture.

As best seen in FIG. 14, the fingerboard 186 includes a mound 190 on which each fret 130 is mounted. The mounds 190 are spaced apart by flat portions 191. As with the prior embodiment, it will be recognized by those skilled in the art that numerous shapes may be given to the fingerboard 186. It will also be recognized that the frets 130 may take many cross-sectional shapes, and may further include barbs, tangs, or other projections 109 (i.e. small triangular, square, tangs, or sharp edges) which the composite sheets 106 may form around to securely grip the fret 130 and hold it to the resulting fingerboard 186.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A head assembly for a stringed instrument having a plurality of strings, the head assembly comprising:

a headpiece;

a plurality of vertically adjustable nuts connected to the headpiece and positioned to engage the plurality strings, the number of nuts corresponding to the number of strings; and means for individually adjusting the vertical position of each of the plurality of nuts.

2. The head assembly of claim 1, wherein the adjusting means provides continuously variable adjustment.

3. A head assembly for a stringed instrument having a plurality of strings, the head assembly comprising:

a headpiece;

a plurality of vertically adjustable nuts connected to the headpiece and positioned to engage the plurality strings, the number of nuts corresponding to the number of strings; and a plurality of screws engaging both the headpiece and the plurality of nuts for individually adjusting the vertical position of each of the plurality of nuts.

4. The head assembly of claim 3, wherein the headpiece defines a first plurality of holes and second plurality of holes, the first plurality of holes sized to receive the plurality of nuts, the second plurality of holes having internal threads and sized to receive the plurality of screws.

5. The head assembly of claim 4, wherein the first plurality of holes and second plurality of holes horizontally overlap.

6. The head assembly of claim 4, wherein the second plurality of holes and the plurality of screws are sized such that the plurality of screws remain below an upper surface of the headpiece.

7. The head assembly of claim 3, wherein each nut includes a horizontally facing recess sized to receive a portion of the corresponding screw.

8. The head assembly of claim 7, wherein each recess includes upper and lower surfaces positioned to engage the corresponding screw.

9. The head assembly of claim 3, wherein each screw includes a female Allen receptacle.

10. The head assembly of claim 1, wherein each nut includes a vertically facing notch.

11. The head assembly of claim 10, wherein each notch includes sloped surface having a peak for engaging a string.

12. A head assembly for a stringed instrument having a plurality of strings, the head assembly comprising:

a headpiece;

a plurality of vertically adjustable nuts connected to the headpiece and positioned to engage the plurality strings, the number of nuts corresponding to the number of strings;

means for individually adjusting the vertical position of each of the plurality of nuts; and a plurality of drawbars for engaging the plurality of strings, the plurality of drawbars being horizontally adjustable.

13. The head assembly of claim 12, wherein the headpiece defines a block, and further comprising a plurality of tensioner screws extending through the block and engaging the plurality drawbars.

14. The head assembly of claim 13, wherein each tensioner screw includes a thumb nut for grasping by a musician, and wherein each thumb nut has a different horizontal length than its adjacent thumb nuts.

15. The head assembly of claim 13, wherein each tensioner screw includes a thumb nut sized to be grasped and rotated by a musician's fingers, and wherein each thumb nut includes a female Allen receptacle.

16. The head assembly of claim 12, wherein the headpiece defines a plurality of horizontal slots, and wherein each of the drawbars includes a post positioned in a slot for guiding the translation of the drawbar.

* * * * *